US005082110A

United States Patent [19]

Hager

[11] Patent Number: 5,082,110

[45] Date of Patent: Jan. 21, 1992

[54] PROTECTIVE CASE FOR COLLECTIBLE BASEBALLS

[76] Inventor: Alan C. Hager, 65 High Ridge Rd., Suite 227, Stamford, Conn. 06905

[21] Appl. No.: 678,715

[22] Filed: Apr. 1, 1991

[51] Int. Cl.[5] ..... B65D 85/00

[52] U.S. Cl. ..... 206/232; D11/131; 206/45.34; 206/315.9

[58] Field of Search ..... D6/472; D11/131; 40/406, 410; 206/315.9, 45.34, 232; 273/25, 60 A, 60 R

[56] References Cited

U.S. PATENT DOCUMENTS

| | | | |
|---|---|---|---|
| D. 158,699 | 5/1950 | Wasilevich | D6/472 |
| D. 290,447 | 6/1987 | Evans | D11/131 |
| 2,551,354 | 5/1951 | Wasilevich | 206/45.34 |
| 2,987,843 | 6/1961 | Anthony | 206/45.34 |
| 4,188,990 | 2/1980 | Ross | 206/315.91 |
| 4,494,650 | 1/1985 | Cullen | 206/315.9 |
| 4,691,824 | 9/1987 | Schindler | 206/315.9 |
| 4,771,902 | 9/1988 | Teng | 206/45.34 |
| 4,817,311 | 4/1989 | Ong | 40/410 |
| 4,877,166 | 10/1989 | Gelinas, Jr. | 273/25 |

FOREIGN PATENT DOCUMENTS

| | | | |
|---|---|---|---|
| 2903546 | 8/1980 | Fed. Rep. of Germany | 206/45.31 |

*Primary Examiner*—Jimmy G. Foster
*Attorney, Agent, or Firm*—Norman B. Rainer

[57] ABSTRACT

A protective case is provided for tamper-proof, long term presentation and display of a collectible baseball. The case consists of a transparent dome, a baseplate that seals the dome, and a transparent disc that secures a documentation panel to the underside of the baseplate. The dome and baseplate are configured such that the baseball is held therebetween in an immobilized state. With the baseball in place, the dome and baseplate are bonded together, preferably by cohesive bonding techniques such as sonic welding.

7 Claims, 3 Drawing Sheets

PROTECTIVE CASE FOR COLLECTIBLE BASEBALLS

BACKGROUND OF THE INVENTION

1. Field of the Invention

This invention relates to the protective long term storage of spherical collectible items and more particularly concerns a protective case for the storage of autographed baseballs.

2. Description of the Prior Art

Whether as a hobby or for investment purposes, there is considerable interest in collecting autographed baseballs, particularly those signed by well known professional baseball players. Often the baseball is signed by a number of players and the signatures are randomly spaced about the surface of the baseball. In some instances, the label printed upon the ball by the manufacturer has additional collector's significance.

The economic value of the baseball is dependent primarily upon its age, physical condition, and rarity and number of autographs inscribed upon its surface. Service companies are available for providing accurate and consistent appraisal and authentication of autographed baseballs. One such company is Acu-Card, Inc. of Stamford, Conn. Culminating their review, Acu-Card will encase the baseball to preserve its attested authenticity and protect it from physical damage. The cases utilized for such purpose are generally configured of two transparent plastic components: a substantially flat circular base plate and a cylindrical dome having a semispherical top and an open bottom adapted to receive the baseball and join the base plate. Such cases usually incorporate means for the display of documentary indicia supplied by the service company. Said indicia is generally printed upon card stock and may include a catalog number, date of signature, name of the player and his team, name of the service company, and relevant serial numbers.

Earlier known enclosures for displaying souvenir baseballs are not tamper-proof and do not preserve the condition of the baseball and autograph. For example, solvent vapors from glues employed for sealing the cases have been found to adversely affect the leather covering of the baseball, and the ink used in the signature. Other cases do not provide means for immobilizing the baseball, thereby permitting the signature to deleteriously rub against the interior sidewalls of the case when moved about. Furthermore, the ball may rotate within the case in a manner to obscure the autograph or label.

It is accordingly an object of this invention to provide a tamper-proof protective case for the storage and long term preservation and display of a baseball.

It is another object of this invention to provide a case as in the foregoing object which may be readily sealed without causing immediate or long term damage to the baseball.

It is a further object of the present invention to provide a case of the aforesaid nature which provides means for immobilizing the baseball within the case.

It is still another object of the present invention to provide a case of the aforesaid nature of rugged, durable construction amenable to low cost manufacture.

These objects and other objects and advantages of the invention will be apparent from the following description.

SUMMARY OF THE INVENTION

The above and other beneficial objects and advantages are accomplished in accordance with the present invention by a case for protectively confining a collectible baseball, said case comprised of:

a) a transparent dome comprised of a circular cylindrical sidewall portion and a semispherical upper portion, said sidewall portion having a lower extremity encircled by a flat outwardly directed first lateral shoulder and having at least two downwardly directed posts, said upper portion having downwardly directed holding means, b) a baseplate bounded by a circumferential edge and upper and lower surfaces, and having an upwardly directed concave depression adapted to seat a baseball, apertures spaced apart to receive said posts, and a second lateral shoulder configured to abut with and be bonded to said first lateral shoulder, and a downwardly opening recess associated with said lower surface, c) a transparent disc disposed within said recess and bonded to said baseplate, and d) a thin documentation panel sandwiched between said disc and the lower surface of said baseplate, whereby e) the bonding of said dome to said baseplate causes a baseball disposed within said dome to be immobilized by engagement between said downwardly directed holding means and said concave depression.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
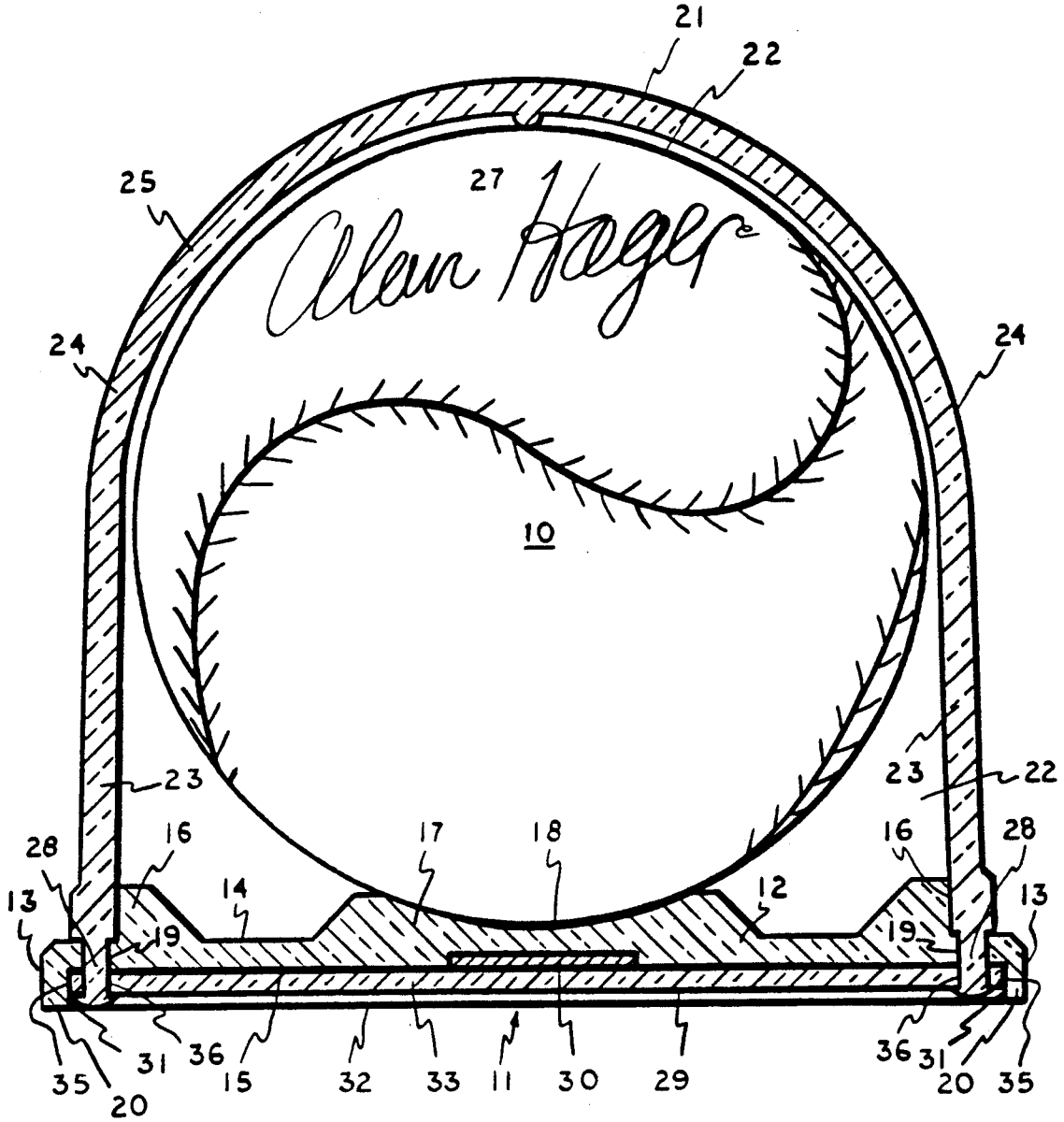
FIG. 1 is a sectional side view of an embodiment of the baseball case of the present invention shown in functional engagement with a baseball.
Figure 2:
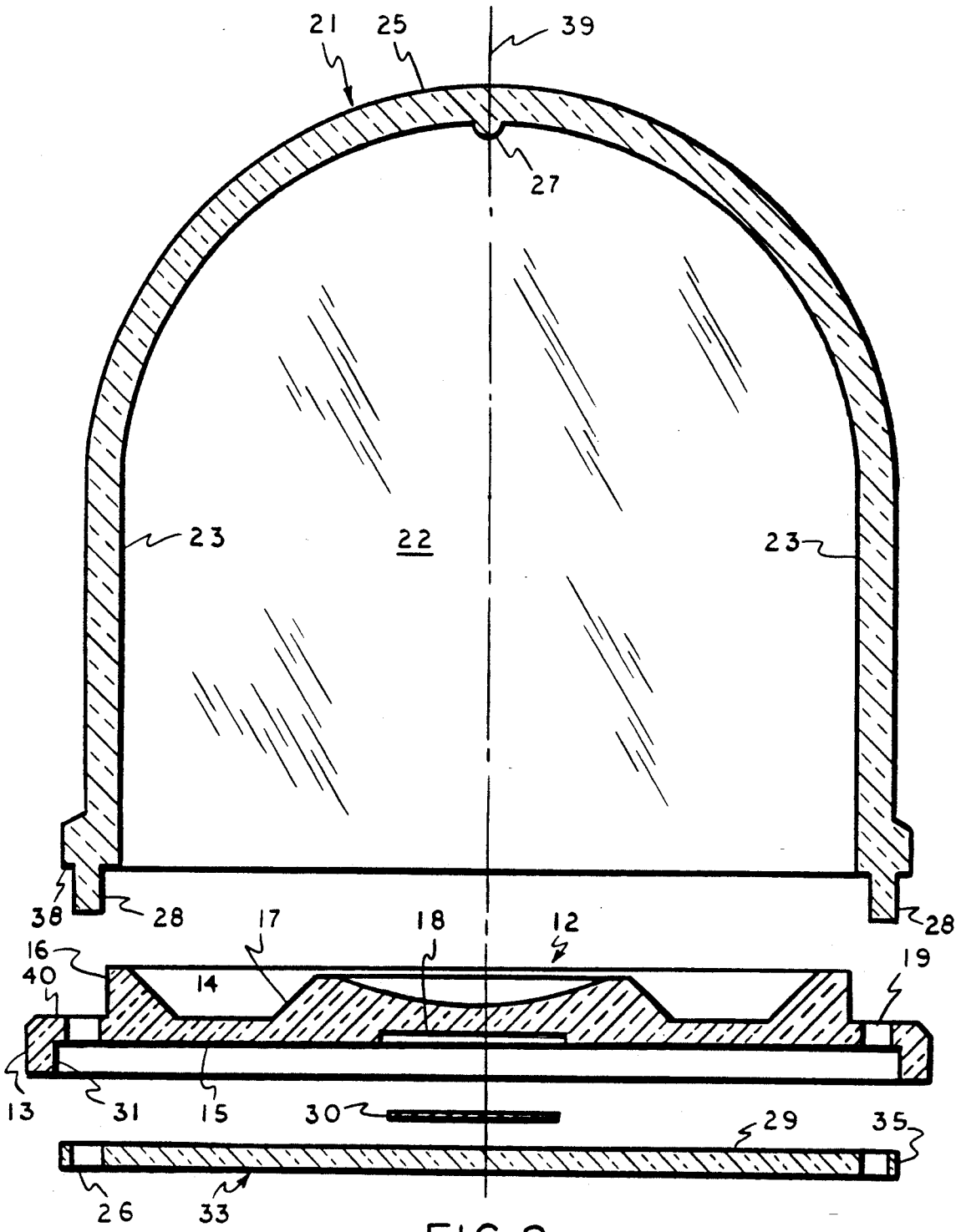
FIG. 2 is an exploded sectional side view of the embodiment of FIG. 1.
Figure 3:
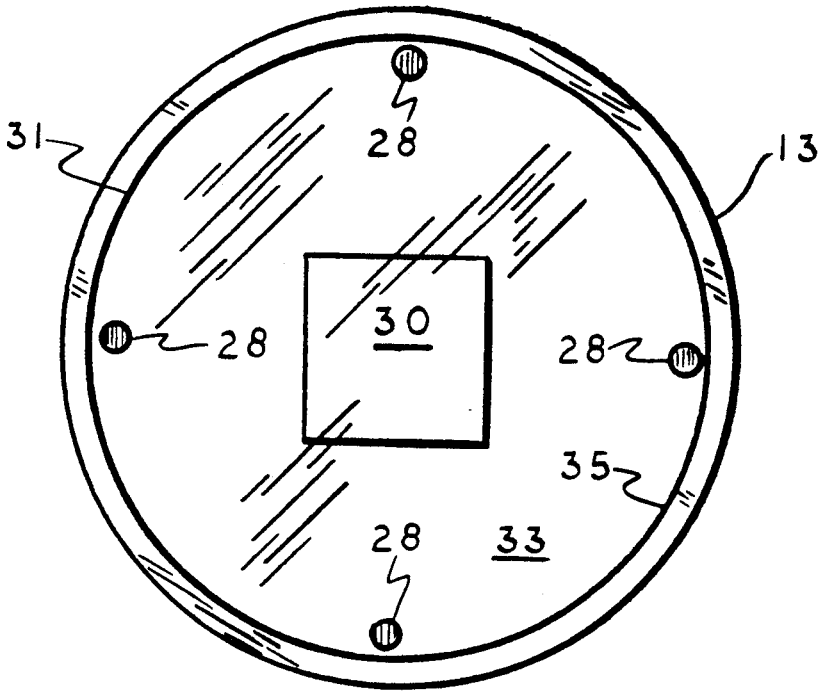
FIG. 3 is a bottom view of the baseball case of FIG. 1.

Referring to FIGS. 1-3, an embodiment of a baseball case 11 of the present invention is shown in operative association with baseball 10. Said baseball case is comprised of a transparent dome 21, a circular baseplate 12 that seals said dome, and a transparent disc 33 adapted to fit beneath baseplate 12 to embrace a documentation card 30.

Dome 21 is comprised of circular cylindrical sidewall portion 23 centered upon vertical axis 39, and semispherical upper portion 25, said portions defining interior region 22. Lower extremity 26 of said wall portion is encircled by a flat, outerwardly directed first lateral shoulder 38. Four posts 28 are downwardly directed from said lower extremity as continuous integral extensions thereof, said posts being uniformly spaced about the circular perimeter of lower extremity 26. Holding means in the form of downwardly directed tab 27 is centered upon axis 39 and adapted to contact the top of the baseball.

Baseplate 12 is bounded by circumferential edge 13 and upper and lower surfaces 14 and 15, respectively. A cylindric positioning surface 16, centered upon axis 39, extends upwardly from upper surface 14 adjacent edge 13. Pedestal portion 17, upwardly emergent from upper surface 14 and centered upon axis 39, is provided with upwardly directed concave spherical depression 18 to seat said baseball. Apertures 19, communicating between said upper and lower surfaces, are located between edge 13 and positioning surface 16, and spaced in a manner to receive posts 28. A second lateral shoulder 40 is disposed between edge 13 and positioning surface 16.

In the assembled case shown in FIG. 1, posts 28 penetrate apertures 19. First and second lateral shoulders 38 and 40, respectively, are in abutment, forming a sealing perimeter around the dome. The dome is bonded to the baseplate at said sealing perimeter preferably by cohesive fusion techniques such as sonic welding or dielectric heating. Such cohesive bonding methods obviate the use of solvents or other volatile species common to most adhesives and which could deleteriously affect the baseball on long storage. Prior to or during the bonding operation, which achieves air-impervious joinder of the dome to the baseplate, the air within the dome may be replaced with an inert gas. Upon bonding of the dome to the baseplate, the baseball held within the case is immobilized by concertive contact with tab 27 and depression 18.

The underside of baseplate 12 is provided with a downwardly opening recess 32 bounded by lower surface 15 and cylindric shoulder 31 located between apertures 19 and circumferential edge 13.

Transparent disc 33 has a circular boundary edge 35 whose diameter is such as to make tight-fitting engagement with cylindric shoulder 31. The thickness of disc 33 is such as to enable it to fit within recess 32. Disc 33 is further provided with apertures 36 which align with apertures 19 of the baseplate.

Documentation card 30 is disposed between lower surface 15 of the baseplate and disc 33. In the fully assembled case, posts 28 penetrate apertures 36 in disc 33 and may be thermally shaped to grip the lower surface of the disc. Further bonding may be provided about the sites where posts 28 penetrate apertures 36. Still further bonding may be effected where the boundary edge 35 of the disc engages cylindric shoulder 31. In such manner of assembly, the documentation card is sealed in place and is visible through the transparent disc. The several components of the case of this invention may be fabricated of transparent thermoplastic polymers such as polycarbonates and polyacrylates.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A case for protectively confining a collectible baseball, said case comprised of:

a) a transparent dome comprised of a circular cylindrical sidewall portion and a semispherical upper portion, said sidewall portion having a lower extremity encircled by a flat outwardly directed first lateral shoulder and having at least two downwardly directed posts, said upper portion having downwardly directed holding means, b) a baseplate bounded by a circumferential edge and upper and lower surfaces, and having an upwardly directed concave depression adapted to seat a baseball, apertures spaced apart to receive said posts, and a second lateral shoulder configured to abut with and be bonded to said first lateral shoulder, and a downwardly opening recess associated with said lower surface, c) a transparent disc disposed within said recess and bonded to said baseplate, and d) a thin documentation panel sandwiched between said disc and the lower surface of said baseplate, whereby e) the bonding of said dome to said baseplate causes a baseball disposed within said dome to be immobilized by engagement between said downwardly directed holding means and said concave depression.

2. The case of claim 1 wherein said dome and baseplate are each of monolithic construction fabricated of transparent thermoplastic polymer.

3. The case of claim 2 wherein said polymer is a polyacrylate.

4. The combination of the case of claim 2 and a collectible baseball held within said case, said first lateral shoulder being cohesively bonded to said second lateral shoulder.

5. The combination of claim 4 wherein said cohesive bonding is a weld produced by sonic means.

6. The combination of claim 5 wherein said case confines a gas other than air, said gas being inert with respect to said baseball.

7. The case of claim 2 wherein said dome, baseplate and disc are all fabricated of the same polymer.

* * * * *